US005595537A

United States Patent [19]

Jungemann et al.

[11] Patent Number: 5,595,537

[45] Date of Patent: Jan. 21, 1997

[54] SELF-PROPELLING HARVESTER THRESHER

[75] Inventors: Ludger Jungemann, Lippstadt; Hermann Dreesbeimdieke, Guetersloh; Lambert Sanders, Herzebrock-Clarholz, all of Germany

[73] Assignee: Claas oHG beschraenkt haftende offene Handelsgesellschaft, Harsewinkel, Germany

[21] Appl. No.: 387,254

[22] Filed: Feb. 13, 1995

[30] Foreign Application Priority Data

Feb. 11, 1994 [DE] Germany ..... 44 04 401.1

[51] Int. Cl.[6] ..... A01F 12/54

[52] U.S. Cl. ..... 460/100; 460/119; 56/12.8; 55/290

[58] Field of Search ..... 460/119, 100, 460/117; 56/DIG. 8, 12.8; 55/289, 290, 267, 400

[56] References Cited

U.S. PATENT DOCUMENTS

| | | | |
|---|---|---|---|
| 3,837,149 | 9/1974 | West et al. | 55/290 X |
| 4,153,436 | 5/1979 | Cozine et al. | 55/269 X |
| 4,233,040 | 11/1980 | Vogelaar et al. | 55/290 X |
| 4,443,236 | 4/1984 | Peiler | 55/269 |
| 4,542,785 | 9/1985 | Bagnall et al. | 55/493 X |

FOREIGN PATENT DOCUMENTS

| | | |
|---|---|---|
| 2753133 | 7/1978 | Germany . |
| 3409515 | 3/1988 | Germany . |
| 3911524 | 10/1990 | Germany . |
| 4033204 | 4/1992 | Germany . |

*Primary Examiner*—Terry Lee Melius
*Attorney, Agent, or Firm*—Michael J. Striker

[57] ABSTRACT

A self-propelling harvester thresher has a drive motor, a cooler with a cooler fan for supplying a cooling air, a sieve device arranged before the cooler for retaining dirt particles entrained in the cooling air, an outer housing associated with the sieve device and having a smaller efficient surface than an air inlet surface of the sieve device. The housing has a side which faces toward the sieve device and is at least partially open. A conduit connects the housing with a suction side of a blower. A screening element is arranged inside the sieve device opposite to the open side of the housing. The screening element is formed as an inner housing having a surface which faces toward the end surface of the sieve device and has an opening. The opening of the inner housing of the screening element is greater than the opening of the outer housing connected with the blower.

16 Claims, 5 Drawing Sheets

SELF-PROPELLING HARVESTER THRESHER

BACKGROUND OF THE INVENTION

The present invention relates generally to self-propelling harvester threshers.

More particularly, it relates to a self-propelling harvester thresher which has a drive motor, a cooler with a cooler fan and a rotatable sieve device located before the cooler for retaining dirt particles carried in the aspirated cooling air.

Self-propelling harvester threshers of the above mentioned general type are known in the art. In the known self-propelling harvester threshers a small effective surface of the outer housing of the sieve device forms an air inlet surface, the housing is partially open at the side facing the sieve device and is connected through an outer tubular conduit with the suction side of a suction impeller, whereas inside the sieve device a screening element is arranged. It is located opposite to the open side of the open housing.

This agricultural harvester is disclosed for example in the German document DE 40 33 204 A1. In practice the agricultural harvester of this type is designed so that a screening element associated with the housing is arranged in form of a flat plate inside the rotatably driven sieve device. The suction device is provided forwardly of the rotatable sieve device in the region of its place. It aspirates the dirt particles from the outer surface of the rotatable sieve. It has however been recognized in practice that such a cleaning device does not operate in an optimal manner.

SUMMARY OF THE INVENTION

It is therefore an object of the present invention to provide a self-propelling harvester thresher, which avoids the disadvantages of the prior art.

More particularly, it is an object of the present invention to provide a self-propelling harvester thresher which is designed so that it satisfies high requirements of cleaning efficiency of the rotatable sieve device.

In keeping with these objects and with others which will become apparent hereinafter, one feature of the present invention resides, briefly stated, in a self-propelling harvester thresher, in which the screening element is formed as an inner housing having a surface which faces the sieve device and is open, and the opening of the screening housing is greater than the opening of the outer housing which is connected with the suction side of a blower.

A ring gap is formed because of the different widths of the opposite openings of the inner and outer housings. The greater part of the air flows through said ring gap first through the openings of the rotatable sieve device into the screening housing, is reversed there and then aspirated from inside through the openings of the rotatable sieve device into the outer housing. As a result, the dirt particles are so to say additionally blown out. In this way, an optimal cleaning of the rotatable sieve device is obtained. The arcuate shape of the cleaning housing in its cross-section contributes further to the cleaning action. With the screening housing designed in accordance with the present invention the air which discharges through the housing is positively guided.

For avoiding influencing of the suction action ont he rotatable sieve device by corresponding air-in flow and obtaining a high efficiency, the screening housing in accordance with a further embodiment of the present invention can be provided with sealing strips on its edges.

The guidance of the air inside the screening housing is improved since in accordance with the further embodiment of the present invention the cross-section of the screening housing continuously increases toward the radial casing of the sieve device. Because of the increase of the cross-section, the greater diameter of the sieve device faces outwardly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
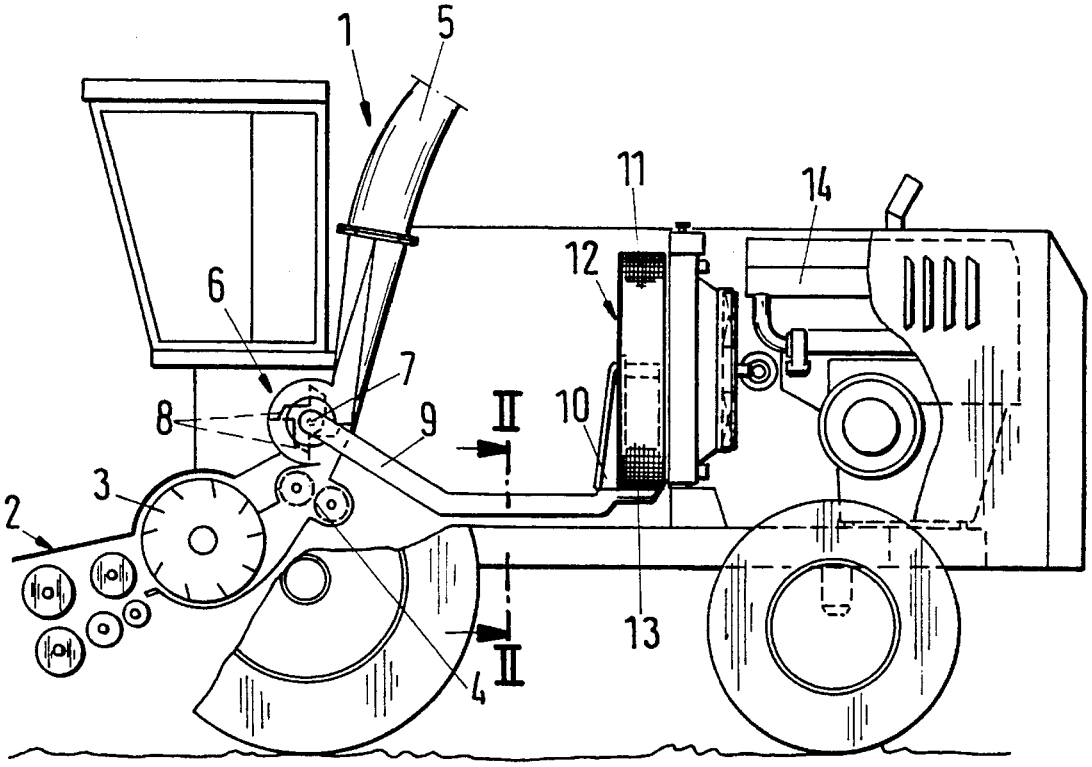
FIG. 1 is a view showing a self-propelling harvester thresher formed as a field chopper, in a side view.

A self-propelling harvester thresher formed as a field chopper is identified with reference numeral 1. It has a product drawing-in element 2 and a chopping aggregate 3 located after the latter. The product comminuted by the chopping aggregate 3 is supplied to a conditioner roller pair 4 in which the chopped product is squeezed.

For throwing the squeezed chopped product through a curved discharge passage 5 for example to a transporting vehicle moving parallel near the field chopper, a post-accelerator 6 is provided after the conditioner roller pair 4 as considered in the transporting direction. It includes substantially a driving axle 7 and associated transporting strips 8 arranged at a distance from the axle 7. The transporting strips 8 mechanically act on the harvested product supplied through the conditioner roller pair and accelerate the harvested product through the discharge passage 5 with corresponding energy.

The post-accelerator is a part of the discharge passage 5. It includes the shaft of the transporting blower which aspirates a powerful air stream axially through openings in its housing side walls. A conduit 9 is connected with one or both suction sides of the post-accelerator. Another end of the conduit 9 is connected with an outer housing 10.

A rotatable sieve device 11 is associated with the housing 10 and covers both a part of its end surface 12 and a part of its casing 13. The housing 10 extends from the periphery of the sieve device 11 towards its axis of rotation. The housing 10 has a side which faces the rotatable sieve device 11 and is open. This side can be provided with a single opening 10' or a plurality of openings. Therefore dust and impurities adhering to the outer surface of the sieve device can be aspirated through the conduit 9. In this way it is guaranteed that on the one hand the rotating sieve device is not clogged and on the other hand an overheating and dirtying of the motor 14 is avoided since the aspirated particles leave the machine chamber through the discharge passage together with the chopped product.

Figure 1A:
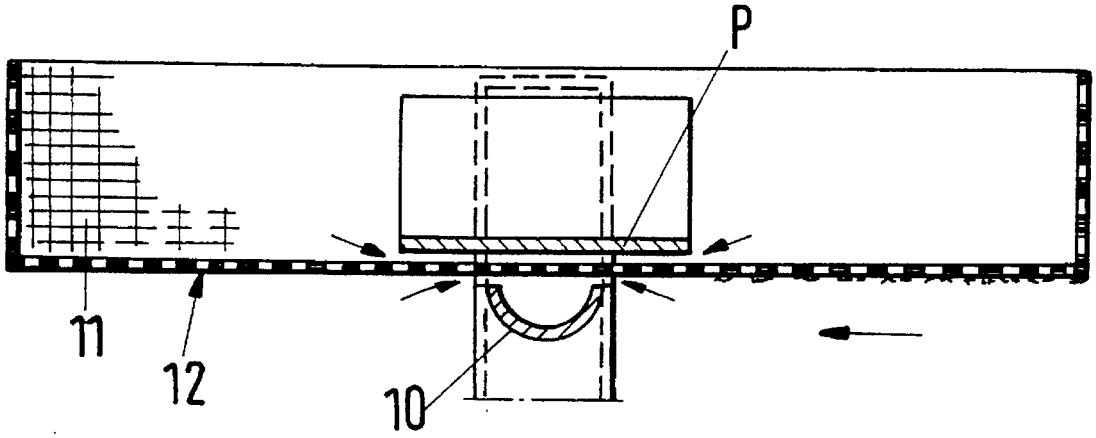
FIG. 1*a* is a principal sketch of an air guidance in accordance with the prior art.
Figure 1B:
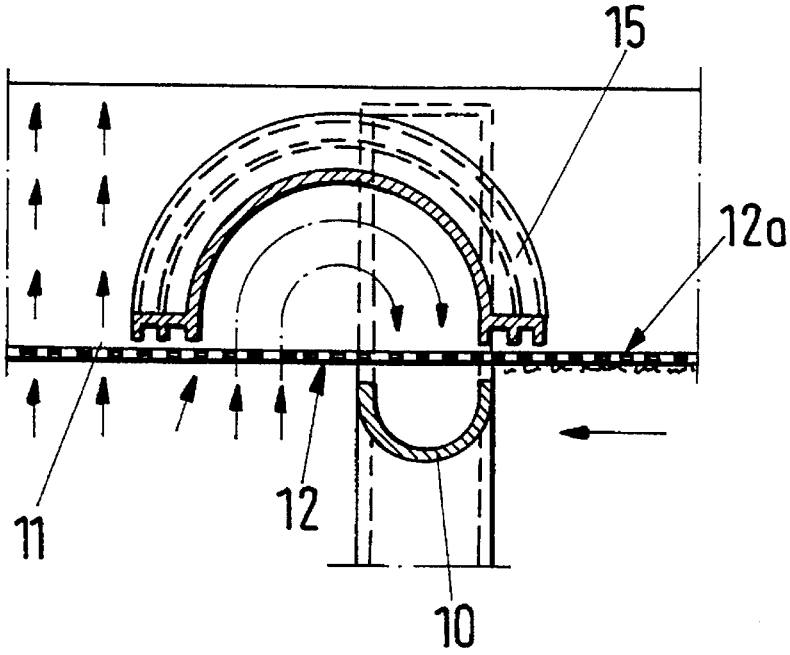
FIG. 1*b* is a principal sketch of the air guide in accordance with the present invention.

Reference numeral 15 identifies a screening housing which is arranged in the interior of the sieve device 11. FIG. 1*a* shows that the screening element which has been known before is formed as a flat plate as identified with P. It has an angled form oriented opposite to the perpendicular and the radially inner surface of the sieve device 11. As identified in FIG. 1*a* by the arrow, the air which flows through the housing 10 is aspirated through the gaps between the sieve device 11 and the housing 10 as well as the plate P. The cleaning action is correspondingly unsatisfactory, since namely impurities are sucked out substantially only from the outer surface of the rotatable sieve device.

In the agricultural harvester of the present invention, the screening housing has a surface which faces the end surface 12 of the rotatable sieve device 11 and is located opposite to the opening 10' of the housing 10. This surface is provided with an opening 15' which is greater than the opening 10' of the housing 10. Therefore, it can be seen that the air first flows laterally near the housing 10 through the end surface 12 of the rotatable sieve device into the interior of the screening housing 15, then is deflected there, and then is drawn from inside through the perforated end surface 12 into the outer housing 10. By the thusly reinforced air stream, not only the outer surface of the sieve device 11, but also its suction openings are reliably cleaned.

Figure 2:
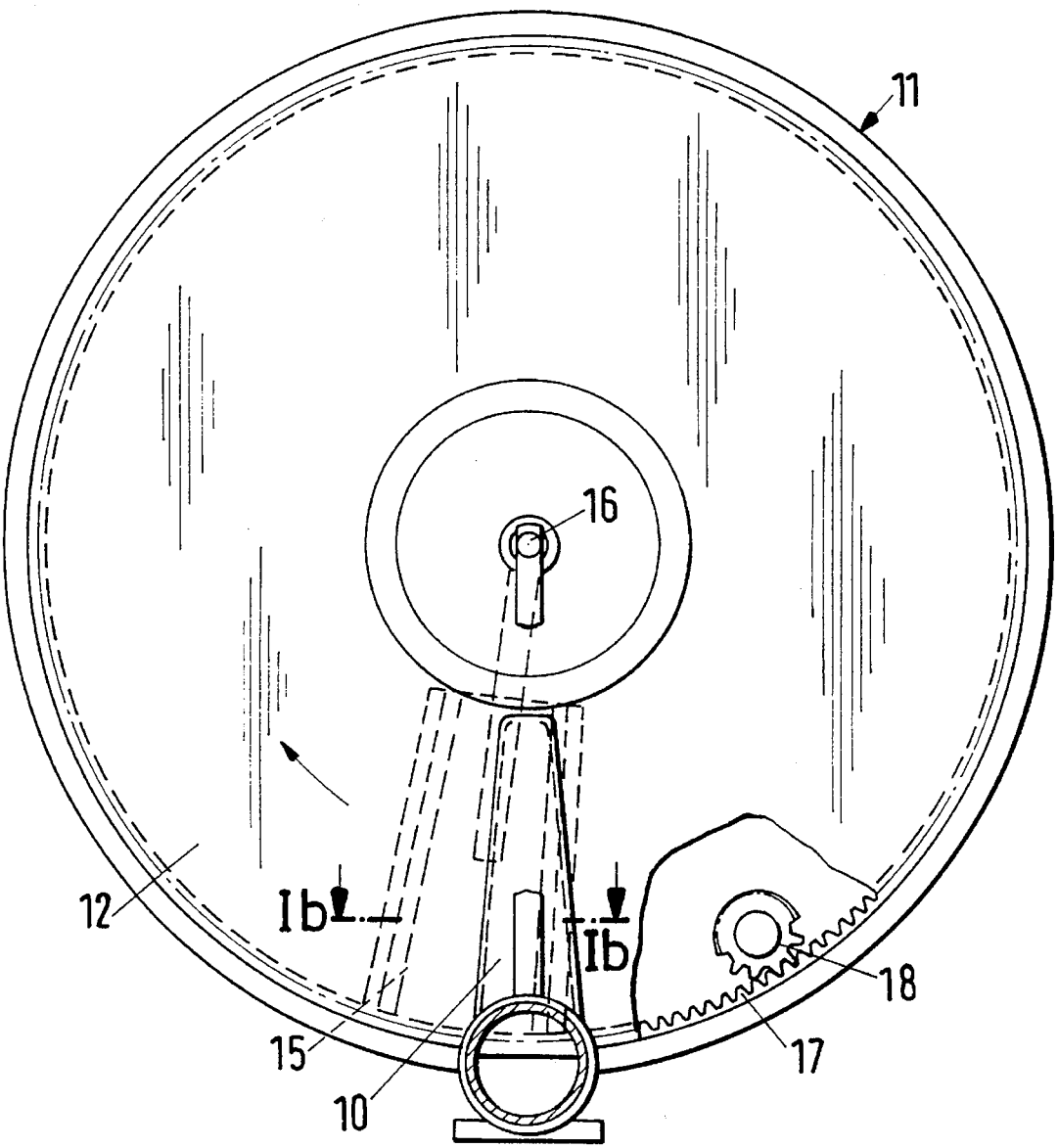
FIG. 2 is a view showing a rotatably driven sieve device in an end view and a section taken along the line II—II in FIG. 1.
Figure 3:
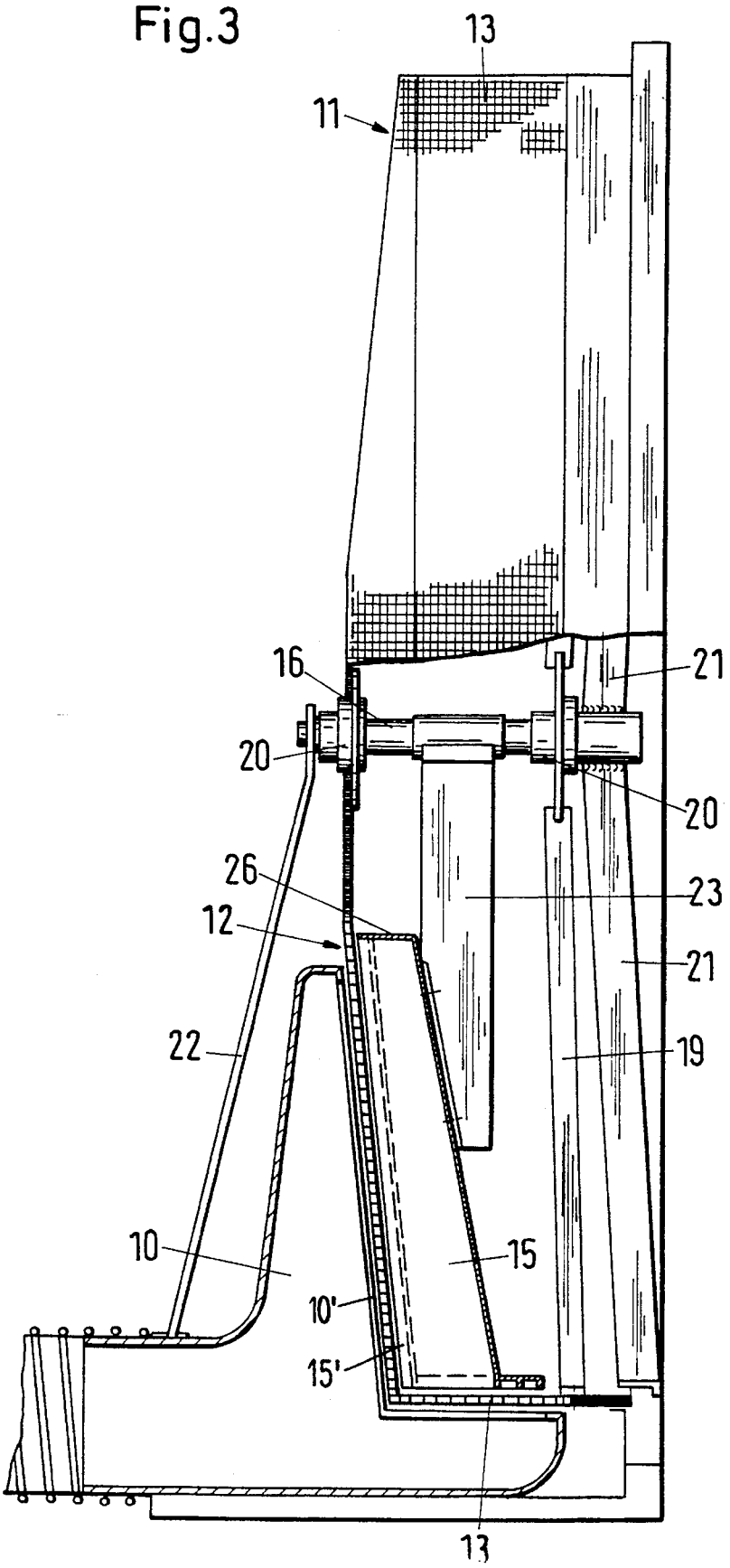
FIG. 3 is a view showing a rotatably driven sieve device as seen from the side on an outer casing of the sieve device.
Figure 4:
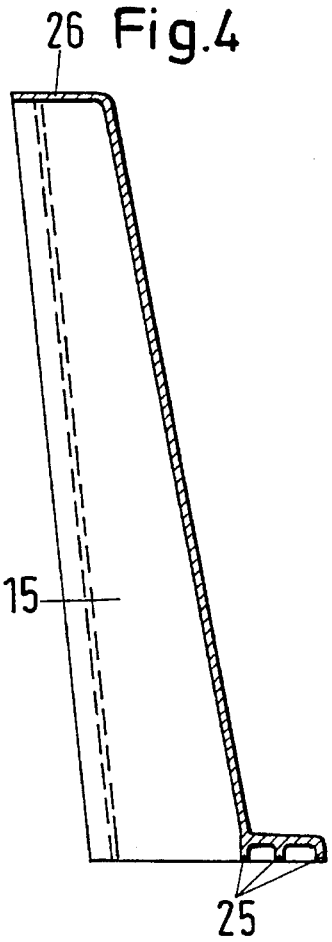
FIG. 4 is a view showing a screening hood in a section taken along the line IV—IV in FIG. 5.

FIGS. 2 and 3 show the drive of the rotatable sieve device 11. For driving the sieve device, the basket of the sieve device 11 is rotatably supported on a rotatable shaft 16. A toothed rim 17 with an inner tooth engages with a drive pinion 18. The drive pinion 18 is fixedly mounted on the drive pin of a motor in a not shown manner.

As can be seen from FIG. 3, the basket of the sieve device 11 is mounted on the bar-like basket holder 19. The basket holder as well as the opposite wall of the basket of the sieve device 11 are fixedly connected with two hubs 20 rotatably supported on the fixed shaft 16. Frame-fixed braces 21 are provided for stabilization purposes. They are arranged on the side facing away from the outer housing 10. On the side facing toward the housing 10, a further fixed brace 22 is arranged. It is mounted with its opposite end on the housing 10. A screening inner housing 15 is mounted on a bar-shaped holder 23 which is also arranged on the shaft 16 by a sleeve.

Figure 5:
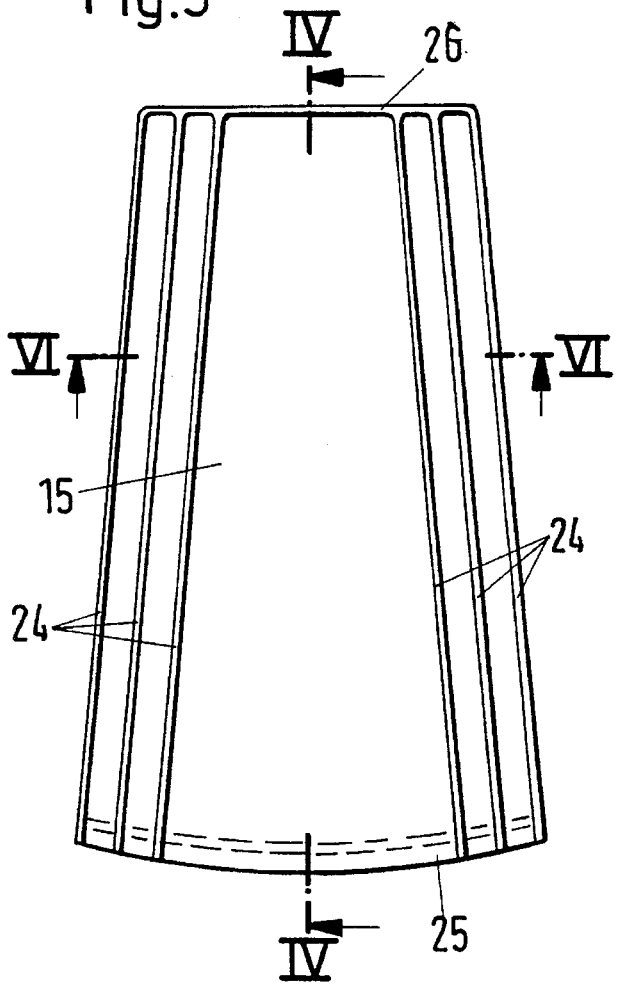
FIG. 5 is a view showing a screening housing in an end view from the side of the rotatable sieve device.
Figure 7:
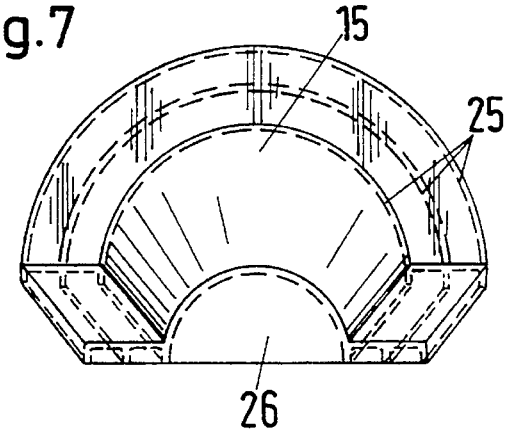
FIG. 7 is a view showing the screening housing on a view in direction of the arrow VII in FIGS. 4 and 5.
Figure 6:
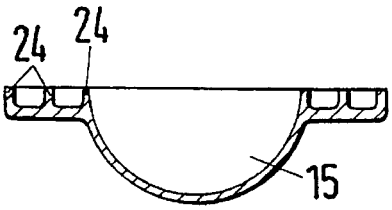
FIG. 6 is a view showing a section taken through the sectioned housing along the line VI—VI in FIG. 5.

FIGS. 4–7 show the screening housing 15 as an individual unit. From FIGS. 4, 5, 7 in connection with FIG. 3 it can be seen that it conically expands toward an outer surface of the sieve device. As shown in FIG. 6, it has a semi-circular cross-section. As shown in FIG. 5, the edge which is associated with the radial surface 13 of the sieve device 11 is formed in an arc. Sealing strips 24 are arranged on both longitudinal sides which face the housing 10. They form a labyrinth. The screening housing 15 is also provided with arcuate sealing strips 25 at the side facing toward the radial surface 13 of the sieve device 11. They describe a semi-circle. The strips 25 are however located at the side which faces away from the housing 10. The distances between the strips are equal to substantially double their height.

The basket of the screening housing 15 associated with the fixed shaft 16 is identified with reference numeral 26. The screening housing 15 can be formed with a plurality of folds, in particular with respect to its cross-section. It is important that the air guiding strips 24 and 25 which form the labyrinth are provided. In the shown embodiment the basket of the sieve device 11 is rotatably driven. In deviation from this embodiment, it is of course possible that the basket of the sieve device or a circular round sieve wall is fixed, while the housing 10 and the screening hood 15 are rotatably driven. It is also recommended that the housing 10 in combination with the screening hood 15 can act on the sieve surfaces in a multiple embodiment.

It will be understood that each of the elements described above, or two or more together, may also find a useful application in other types of constructions differing from the types described above.

While the invention has been illustrated and described as embodied in a self-propelling harvester thresher, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A self-propelling harvester thresher, comprising a blower; a cooler with a cooler fan for supplying a cooling air; a rotatable sieve device arranged between said cooler for retaining dirt particles entrained in the cooling air; a stationary outer housing having an inner chamber communicating with said blower and having a side which faces toward said sieve device and is provided with an opening; a conduit communicating said inner chamber of said outer housing with a suction side of said blower; a screening element formed as an inner housing having an inner chamber and arranged inside said sieve device opposite to said opening of said outer housing, said screening element having a side which faces towards said end surface of said sieve device and has an opening, said opening of said screening element being greater than said opening of said outer housing.

2. A self-propelling harvester thresher as defined in claim 1, wherein said housings have identical heights and are laterally offset relative to one another.

3. A self-propelling harvester thresher as defined in claim 1, wherein said inner housing has an arcuate cross-section.

4. A self-propelling harvester thresher as defined in claim 1, wherein said inner housing has a semi-circular cross-section.

5. A self-propelling harvester thresher as defined in claim 1, wherein said inner housing has a cross-section which continuously increases toward a radial outer surface of said sieve device.

6. A self-propelling harvester thresher as defined in claim 1, wherein said inner housing has a shape of a longitudinally sectioned truncated cone.

7. A self-propelling harvester thresher as defined in claim 1, wherein said inner housing has longitudinal sides which extend in a radial direction; and further comprising sealing strips arranged at said longitudinal sides at a side facing toward an end side of said sieve device.

8. A self-propelling harvester thresher as defined in claim 7, wherein said sealing strips are labyrinth-shaped.

9. A self-propelling harvester thresher as defined in claim 1; and further comprising sealing strips arranged on said inner housing and facing a radial surface of said sieve device.

10. A self-propelling harvester thresher as defined in claim 1, wherein said sieve device is a component of a plan wall having an inner surface and an end surface, said screening element being arranged on said inner surface while said outer housing being arranged on said end surface and extend around a joint rotary axis.

11. A self-propelling harvester thresher as defined in claim 1, wherein said sieve device has sieve surfaces which act as a combination unit including said screening element and said outer housing.

12. A self-propelling harvester thresher as defined in claim 1, wherein said sieve device has a tooth rim provided with inner teeth, said motor being provided with a drive pinion having teeth engaging with said teeth of said toothed rim.

13. A self-propelling harvester thresher as defined in claim 1; and further comprising a fixed shaft and hubs which are supported on said fixed shaft and support said sieve device.

14. A self-propelling harvester thresher as defined in claim 1; and further comprising a shaft; and a holder which is fixed on said shaft and fixedly supports said inner housing.

15. A self-propelling harvester thresher as defined in claim 1; and further comprising a shaft; and braces which fixedly support said housing on said shaft.

16. A self-propelling harvester thresher, comprising a drive motor; a cooler with a cooler fan for supplying a cooling air; a rotatable sieve device arranged before said cooler for retaining dirt particles entrained in the cooling air; a stationary outer housing associated with said sieve device, said sieve device having a smaller efficient suction surface than an air inlet surface of said outer housing, said outer housing extending from a periphery toward an axis of rotation of said sieve device and having a side which faces toward said sieve device and has an opening; a conduit connecting said outer housing with a suction side of a blower: a screening element arranged inside said sieve device opposite to said open side of said outer housing, said screening element being formed as an inner housing having a surface which faces toward said end surface of said sieve device and has an opening, said opening of said inner housing of said screening element being greater than said opening of said outer housing connected with said blower; a shaft; and several basket holders fixedly connected to and rotatable with said shaft, said sieve device having a basket which is held by said basket holders.

* * * * *